US011101587B2

(12) United States Patent
Hu et al.

(10) Patent No.: US 11,101,587 B2
(45) Date of Patent: Aug. 24, 2021

(54) ELECTRICAL CONNECTOR, MOBILE TERMINAL, AND ELECTRICAL CONNECTOR MANUFACTURING METHOD

(71) Applicant: HUAWEI TECHNOLOGIES CO., LTD., Shenzhen (CN)

(72) Inventors: Suining Hu, Shanghai (CN); Tien Chieh Su, Shanghai (CN); Shihao Zhang, Shanghai (CN); Gaobing Lei, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/648,577

(22) PCT Filed: Sep. 20, 2017

(86) PCT No.: PCT/CN2017/102505

§ 371 (c)(1),
(2) Date: Mar. 18, 2020

(87) PCT Pub. No.: WO2019/056224

PCT Pub. Date: Mar. 28, 2019

(65) Prior Publication Data

US 2020/0235509 A1 Jul. 23, 2020

(51) Int. Cl.
*H01R 13/03* (2006.01)
*C25D 5/10* (2006.01)
(Continued)

(52) U.S. Cl.
CPC ..... *H01R 13/03* (2013.01); *C25D 5/10* (2013.01); *C25D 7/00* (2013.01); *H01R 24/64* (2013.01);
(Continued)

(58) Field of Classification Search
CPC ..... H01R 13/03
See application file for complete search history.

(56) References Cited

U.S. PATENT DOCUMENTS 3,892,638 A 7/1975 Stevens et al.
5,722,861 A 3/1998 Wetter
(Continued)

FOREIGN PATENT DOCUMENTS

CN 201584575 U * 9/2010 ..... H01R 13/533
CN 201584575 U 9/2010
(Continued)

OTHER PUBLICATIONS

Rogers, Andrew , AN1953 Introduction to USB Type-C , Microchip Technology Inc., 2015 (Year: 2015).*
(Continued)

*Primary Examiner* — Ross N Gushi
(74) *Attorney, Agent, or Firm* — Stein IP, LLC

(57) ABSTRACT

An electrical connector, a mobile terminal, and an electrical connector manufacturing method therefor, the electrical connector including at least one first conductive terminal and at least one second conductive terminal, where a first electroplated layer is disposed on an outer surface of the first conductive terminal, a second electroplated layer is disposed on an outer surface of the second conductive terminal, and a material of the second electroplated layer is different from a material of the first electroplated layer. Electroplating costs of the electrical connector are reduced while corrosion resistance of the electrical connector is ensured.

20 Claims, 12 Drawing Sheets

(51) Int. Cl.

| | |
|---|---|
| ***C25D 7/00*** | (2006.01) |
| ***H01R 24/64*** | (2011.01) |
| ***H01R 43/24*** | (2006.01) |
| *H01R 107/00* | (2006.01) |

(52) U.S. Cl.
CPC ..... *H01R 43/24* (2013.01); *H01R 2107/00* (2013.01)

(56) References Cited

U.S. PATENT DOCUMENTS

| | | | | |
|---|---|---|---|---|
| 9,853,399 | B2 * | 12/2017 | Kao | H01R 13/6585 |
| 2012/0074954 | A1 * | 3/2012 | Jaeger | H01R 13/641 324/538 |
| 2012/0100758 | A1 * | 4/2012 | Liaw | H01R 43/16 439/660 |
| 2015/0064986 | A1 | 3/2015 | Retho | |
| 2015/0072557 | A1 | 3/2015 | Kamei et al. | |
| 2017/0271800 | A1 * | 9/2017 | Wagman | H01R 13/40 |

FOREIGN PATENT DOCUMENTS

| | | | | | |
|---|---|---|---|---|---|
| CN | 102760996 | A | | 10/2012 | |
| CN | 203277744 | U | | 11/2013 | |
| CN | 103668369 | A | | 3/2014 | |
| CN | 102936740 | B | | 4/2015 | |
| CN | 205039287 | U | | 2/2016 | |
| CN | 106048680 | A | | 10/2016 | |
| CN | 106549242 | A | | 3/2017 | |
| CN | 206098809 | U | | 4/2017 | |
| CN | 106611907 | A | | 5/2017 | |
| CN | 106711654 | A | | 5/2017 | |
| CN | 107146964 | A | | 9/2017 | |
| CN | 107146964 | A | * | 9/2017 | H01R 13/03 |
| CN | 206498004 | U | | 9/2017 | |
| DE | 202017001425 | U1 | * | 7/2017 | B32B 15/00 |
| DE | 202017001425 | U1 | | 7/2017 | |
| EP | 2846412 | A1 | | 3/2015 | |
| JP | 01315977 | A | * | 12/1989 | H01R 43/20 |
| JP | 0266865 | A | * | 3/1990 | B29C 45/14 |
| JP | H0266665 | A | | 3/1990 | |
| JP | 2000215951 | A | * | 8/2000 | H01R 24/00 |
| JP | 2001307796 | A | * | 11/2001 | H01R 9/15 |
| JP | 2001307796 | A | | 11/2001 | |
| JP | 2002231357 | A | | 8/2002 | |
| JP | 2011167915 | A | | 9/2011 | |
| JP | 2012074372 | A | | 4/2012 | |
| JP | 2013122845 | A | * | 6/2013 | H01R 24/00 |
| JP | 2013191517 | A | | 9/2013 | |
| JP | 2016048689 | A | * | 4/2016 | H01B 7/0823 |
| JP | 3211820 | U | | 8/2017 | |
| KR | 0270040 | Y1 | * | 3/2002 | H01R 13/62 |
| KR | 200270040 | Y1 | | 3/2002 | |
| KR | 20150004240 | A | | 1/2015 | |
| KR | 20150004240 | A | * | 1/2015 | H01R 13/6461 |
| WO | 2015073974 | A2 | | 5/2015 | |

OTHER PUBLICATIONS

Andrew Rogers, "AN1953 Introduction to USB Type-C", Microchip Technology Inc., 2015,total 20 pages.

* cited by examiner

ELECTRICAL CONNECTOR, MOBILE TERMINAL, AND ELECTRICAL CONNECTOR MANUFACTURING METHOD

CROSS-REFERENCE TO RELATED APPLICATION

This application is a National Stage of International Application No. PCT/CN2017/102505, filed on Sep. 20, 2017, which is hereby incorporated by reference in its entirety.

TECHNICAL FIELD

This application relates to the field of electrical connection device technologies, and in particular, to an electrical connector, a mobile terminal, and an electrical connector manufacturing method.

BACKGROUND

An increasingly harsh use environment (fast charging, waterproof, or the like) of a terminal product imposes a higher requirement on quality of an input/output IO) connector. In addition, failure problems such as slow charging, charging icon flashing, no ringtone, and failed On the Go (OTG) recognition that are caused because a conductive terminal of a connector is corroded are particularly prominent among various failures. In the prior art, a precious metal with strong corrosion resistance is used for electroplating. However, because the precious metal is costly and only an immersion plating manner can be used due to an inherent feature of an electroplating solution, consumption of the precious metal increases, thereby causing a sharp increase in electroplating costs.

SUMMARY

Embodiments of this application provide an electrical connector, a mobile terminal, and an electrical connector manufacturing method.

The following technical solutions are used in the embodiments of this application.

According to a first aspect, an embodiment of this application provides an electrical connector. The electrical connector includes a plurality of conductive terminals. The plurality of conductive terminals include at least one first conductive terminal and at least one second conductive terminal. The first conductive terminal and the second conductive terminal are made of a conductive material, to implement an electrical connection function. A first electroplated layer is disposed on an outer surface of the first conductive terminal. The first electroplated layer has a corrosion resistance feature and is configured to prevent the first conductive terminal from being corroded. A second electroplated layer is disposed on an outer surface of the second conductive terminal. The second electroplated layer has a corrosion resistance feature and is configured to prevent the second conductive terminal from being corroded. A material of the second electroplated layer is different from a material of the first electroplated layer. Electroplated layers made of different materials have different corrosion resistance performance (a capability of a material to resist a corrosion damage effect of a surrounding medium).

In this embodiment of this application, the material of the first electroplated layer of the electrical connector is different from the material of the second electroplated layer, so that the first conductive terminal and the second conductive terminal have different corrosion resistance performance. Therefore, conductive terminals of the electrical connector may be selectively electroplated, to meet requirements in different application environments through different electroplating. For example, an electroplated layer (such as one that has a precious metal with strong corrosion resistance) with relatively strong corrosion resistance is formed, through electroplating, on a conductive terminal that is relatively easy to corrode, and an electroplated layer with general corrosion resistance is formed, through electroplating, on a conductive terminal that is less easy to corrode, so that all conductive terminals of the electrical connector have good overall corrosion resistance performance and a long corrosion resistance time, and the electrical connector has a longer life span. In addition, although the electroplated layer with relatively strong corrosion resistance is relatively costly, consumption of an electroplating material with strong corrosion resistance can be reduced for the electrical connector to the greatest extent through selective electroplating, to reduce electroplating costs of the electrical connector. Therefore, the electrical connector has both good corrosion resistance performance and low costs.

It may be understood that in this embodiment of this application, the first electroplated layer may be a single-layer structure or a composite-layer structure. The second electroplated layer may be a single-layer structure or a composite-layer structure. In this embodiment of this application, an example in which the first electroplated layer is a composite-layer structure and the second electroplated layer is a composite-layer structure is used for description.

In an implementation, a split-type carrier design may be used for the first conductive terminal and the second conductive terminal, to meet requirements of separately performing electroplating to form the first electroplated layer and the second electroplated layer, thereby greatly reducing consumption of a costly electroplating material (for example, a precious metal with strong corrosion resistance), and reducing electroplating costs while ensuring corrosion resistance performance. The split-type carrier design means that all first conductive terminals are connected to a first carrier, all second conductive terminals are connected to a second carrier, the first carrier carries all the first conductive terminals to undergo immersion plating, to form first electroplated layers on the first conductive terminals, the second carrier carries all the second conductive terminals to undergo immersion plating, to form second electroplated layers on the second conductive terminals, and then the first carrier and the second carrier are assembled to enable the first conductive terminals and the second conductive terminals to be regularly arranged.

In an implementation, an on potential of the first conductive terminal is higher than an on potential of the second conductive terminal. The first conductive terminal may be a high-potential pin (PIN), for example, virtual bus (VBUS), CC, and SBU. The second conductive terminal may be a low-potential pin (PIN). Corrosion resistance of the first electroplated layer is higher than corrosion resistance of the second electroplated layer. Because the first conductive terminal with high on potential is easier to corrode than the second conductive terminal with low on potential, overall corrosion resistance performance of the electrical connector can be balanced by setting the corrosion resistance of the first electroplated layer to be higher than the corrosion resistance of the second electroplated layer, and the electrical connector has a long corrosion resistance time and a long life span.

In an implementation, the first electroplated layer has a precious metal such as rhodium/ruthenium/palladium in a platinum group metal. For example, the first electroplated layer has a rhodium-ruthenium alloy material. Because the first electroplated layer uses the precious metal with a corrosion resistance capability such as rhodium/ruthenium/palladium in the platinum group metal for stacking in a layer plating solution, the first electroplated layer can significantly improve an electrolytic corrosion resistance capability and a life span of the first conductive terminal, and especially an electrolytic corrosion resistance capability in a humid environment with electricity. Because the first electroplated layer is formed on the outer surface of the first conductive terminal through electroplating and the second electroplated layer formed on the outer surface of the second conductive terminal through electroplating is different from the first electroplated layer, required consumption of a precious metal can be properly controlled even though an immersion plating manner is used for the first electroplated layer due to an inherent feature of an electroplating solution. Thus, a sharp increase in electroplating costs of the electrical connector that is caused because of the increase in consumption of the precious metal is prevented. Therefore, a solution of resisting electrolytic corrosion by performing electroplating by using the platinum group metal (such as rhodium and ruthenium) can be widely applied and promoted.

It may be understood that the platinum group metal (such as rhodium and ruthenium) in the first electroplated layer may be used to form one or more layers in a stacked-layer structure of the first electroplated layer. In this embodiment of this application, an example in which the platinum group metal (such as rhodium and ruthenium) is used to form one layer in the stacked-layer structure of the first electroplated layer is used for description. However, in another embodiment, the platinum group metal (such as rhodium and ruthenium) is used to form two or more layers in the stacked-layer structure of the first electroplated layer, to meet a higher corrosion resistance performance requirement.

In an implementation, the first electroplated layer includes a copper plated layer, a wolfram-nickel plated layer, a gold plated layer, a palladium plated layer, and a rhodium-ruthenium plated layer that are sequentially stacked on the outer surface of the first conductive terminal. The first electroplated layer is manufactured through a series of technologies such as rinsing, activation, copper plating, wolfram-nickel plating, gold plating, palladium plating, rhodium-ruthenium plating, rinsing, and air-drying, so that the rhodium-ruthenium plated layer is deposited on the surface of the first conductive terminal and on an outermost side of the first electroplated layer and that is away from the first conductive terminal, thereby improving corrosion resistance of the first conductive terminal.

A thickness of the rhodium-ruthenium plated layer ranges from 0.25 μm to 2 μm, to ensure corrosion resistance performance of the first electroplated layer.

Thicknesses of other layer structures in the stacked-layer structure of the first electroplated layer are as follows: A thickness of the copper plated layer ranges from 1 μm to 3 μm; a thickness of the wolfram-nickel plated layer ranges from 0.75 μm to 3 μm; a thickness of the gold plated layer ranges from 0.05 μm to 0.5 μm; and a thickness of the palladium plated layer ranges from 0.5 μm to 2 μm.

In an implementation, the second electroplated layer includes a nickel plated layer and a gold plated layer that are disposed in a stacked manner. The second electroplated layer may be manufactured through a series of technologies such as rinsing, activation, nickel plating, gold plating, rinsing, and air-drying. A thickness of the nickel plated layer is approximately 2.0 μm, and a thickness of the gold plated layer is approximately 0.076 μm. The second electroplated layer has low electroplating costs and can meet a corrosion resistance requirement of the second conductive terminal as a low-potential conductive terminal.

Optionally, the electrical connector in this embodiment of this application is a Universal Serial Bus (USB) Type-C interface.

In an embodiment, the electrical connector is a USB female socket. The USB female socket includes a midplate and an upper-row conductive terminal group and a lower-row conductive terminal group that are fastened on two opposite sides of the midplate. The upper-row conductive terminal group includes a first terminal assembly fastened by a first supporting part. The first terminal assembly includes at least one first conductive terminal and at least one second conductive terminal. The lower-row conductive terminal group includes a second terminal assembly fastened by a second supporting part. The second terminal assembly has a same structure as the first terminal assembly.

In another embodiment, the electrical connector is a USB male connector. The USB male connector includes latches and an upper-row conductive terminal group and a lower-row conductive terminal group that are fastened to the latches on a side that the latches face each other. The upper-row conductive terminal group includes a first terminal assembly fastened by a first supporting part. The first terminal assembly includes at least one first conductive terminal and at least one second conductive terminal. The lower-row conductive terminal group includes a second terminal assembly fastened by a second supporting part. The second terminal assembly has a same structure as the first terminal assembly. The first supporting part is fit into the second supporting part. The latch is configured to fit into a female socket corresponding to the USB male connector.

According to a second aspect, an embodiment of this application further provides a mobile terminal. The mobile terminal includes the electrical connector described in the foregoing embodiment. The mobile terminal in this embodiment of this application may be any device that has a communication function and a storage function, such as an intelligent device that has a network function, for example, a tablet computer, a mobile phone, an e-reader, a remote control, a personal computer, a notebook computer, an in-vehicle device, a web television, or a wearable device.

According to a third aspect, an embodiment of this application further provides an electrical connector manufacturing method. The electrical connector manufacturing method may be used to manufacture the electrical connector described in the foregoing embodiment.

The electrical connector manufacturing method includes:

providing a first carrier and at least one first conductive terminal connected to the first carrier, and electroplating the first conductive terminal to form a first electroplated layer, where the first carrier and the first conductive terminal may be stamped from a single conductive plate (for example, a copper plate), and the first carrier carries all first conductive terminals to undergo electroplating, to form first electroplated layers on the first conductive terminals;

providing a second carrier and at least one second conductive terminal connected to the second carrier, and electroplating the second conductive terminal to form a second electroplated layer, where a material of the second electroplated layer is different from a material of the first electroplated layer, the second carrier and the second conductive terminal may be stamped from a single conductive plate (for example, a copper plate), the second carrier carries all second conductive terminals to undergo electroplating, to form second electroplated layers on the second conductive terminals, and the material of the second electroplated layer of the electrical connector is different from the material of the second electroplated layer, so that the first conductive terminal and the second conductive terminal have different corrosion resistance performance;

stacking the first carrier and the second carrier, so that the first conductive terminal and the second conductive terminal are arranged in a spaced manner in a row in a same plane to form a first terminal assembly, where a same structure design is used for the second carrier and the first carrier, to quickly implement alignment of the second carrier and the first carrier and improve stacking precision during stacking; and forming a first supporting part on the first terminal assembly in an insert molding manner, where the first supporting part is fastened and connected to the first conductive terminal and the second conductive terminal, and an insulation material is used for the first supporting part.

In this embodiment of this application, because the first conductive terminal is connected to the first carrier and the second conductive terminal is connected to the second carrier, the first conductive terminal and the second conductive terminal can be separately electroplated to meet respective electroplating requirements of the first electroplated layer and the second electroplated layer, thereby greatly reducing consumption of a costly electroplating material (for example, a precious metal with strong corrosion resistance), and reducing electroplating costs while ensuring corrosion resistance performance. The first supporting part is formed on the first terminal assembly in the insert molding manner, to improve processing precision of the first supporting part and robustness of a connection between the first conductive terminal and the second conductive terminal.

In an implementation, an on potential of the first conductive terminal is higher than an on potential of the second conductive terminal, and corrosion resistance of the first electroplated layer is higher than corrosion resistance of the second electroplated layer. The first conductive terminal may be a high-potential pin (PIN), for example, VBUS, CC, and SBU. Because the first conductive terminal with high on potential is easier to corrode than the second conductive terminal with low on potential, overall corrosion resistance performance of the electrical connector can be balanced by setting the corrosion resistance of the first electroplated layer to be higher than the corrosion resistance of the second electroplated layer, and the electrical connector has a long corrosion resistance time and a long life span.

In an implementation, a process of electroplating the first conductive terminal to form the first electroplated layer includes:

performing electroplating to form a copper plated layer on an outer surface of the first conductive terminal, where a thickness of the copper plated layer ranges from 1 μm to 3 μm;

performing electroplating to form a wolfram-nickel plated layer on the copper plated layer, where a thickness of the wolfram-nickel plated layer ranges from 0.75 μm to 3 μm;

performing electroplating to form a gold plated layer on the wolfram-nickel plated layer, where a thickness of the gold plated layer ranges from 0.05 μm to 0.5 μm;

performing electroplating to form a palladium plated layer on the gold plated layer, where a thickness of the palladium plated layer ranges from 0.5 μm to 2 μm; and performing electroplating to form a rhodium-ruthenium plated layer on the palladium plated layer, where a thickness of the rhodium-ruthenium plated layer ranges from 0.25 μm to 2 μm.

In this embodiment, because the first electroplated layer uses a precious metal with a corrosion resistance capability such as rhodium/ruthenium/palladium in a platinum group metal for stacking in a layer plating solution, the first electroplated layer can significantly improve an electrolytic corrosion resistance capability and a life span of the first conductive terminal, and especially an electrolytic corrosion resistance capability in a humid environment with electricity. Because the first electroplated layer is formed on the outer surface of the first conductive terminal through electroplating and the second electroplated layer formed on the outer surface of the second conductive terminal through electroplating is different from the first electroplated layer, required consumption of a precious metal can be properly controlled even though an immersion plating manner is used for the first electroplated layer due to an inherent feature of an electroplating solution, to prevent a sharp increase in electroplating costs of the electrical connector that is caused because the consumption of the precious metal increases. Therefore, a solution of resisting electrolytic corrosion by performing electroplating by using the platinum group metal (such as rhodium and ruthenium) can be widely applied and promoted.

In an implementation, before the copper plated layer is formed through electroplating, the process of electroplating the first conductive terminal to form the first electroplated layer further includes:

rinsing the outer surface of the first conductive terminal, where in this case, the outer surface of the first conductive terminal has a relatively high degree of cleanliness, to meet a cleanliness requirement of a subsequent technology; and activating an oxide film on the outer surface of the first conductive terminal.

After the rhodium-ruthenium plated layer is formed through electroplating, the process of electroplating the first conductive terminal to form the first electroplated layer further includes:

rinsing and air-drying the rhodium-ruthenium plated layer to form the first electroplated layer.

In this embodiment, the first electroplated layer is manufactured through a series of technologies such as rinsing, activation, copper plating, wolfram-nickel plating, gold plating, palladium plating, rhodium-ruthenium plating, rinsing, and air-drying, so that the rhodium-ruthenium plated layer is deposited on the surface of the first conductive terminal and on an outermost side of the first electroplated layer and that is away from the first conductive terminal, thereby improving corrosion resistance of the first conductive terminal.

In an implementation, a process of electroplating the second conductive terminal to form the second electroplated layer includes:

performing electroplating to form a nickel plated layer on an outer surface of the second conductive terminal, where a thickness of the nickel plated layer is approximately 2.0 μm; and before the nickel plated layer is formed through electroplating, the outer surface of the second conductive terminal is rinsed, and an oxide film on the outer surface of the second conductive terminal is activated; and performing electroplating to form a gold plated layer on the nickel plated layer, so as to form the second electroplated layer, where a thickness of the gold plated layer is approximately 0.076 μm; and after the gold plated layer is formed, the gold plated layer is rinsed and air-dried.

In this embodiment, the second electroplated layer has low electroplating costs and can meet a corrosion resistance requirement of the second conductive terminal as a low-potential conductive terminal.

In an implementation, the providing a first carrier and at least one first conductive terminal connected to the first carrier includes: stamping the first carrier and the at least one first conductive terminal from a first conductive plate, where the first carrier has a first local part and a first connection part, the first connection part is connected between the first local part and the first conductive terminal, the first conductive terminal diverges from the first local part at a first distance (in other words, a width of a gap between the first conductive terminal and the first local part is the first distance), and the first local part has a first thickness.

The providing a second carrier and at least one second conductive terminal connected to the second carrier includes: stamping the second carrier and the at least one second conductive terminal from a second conductive plate, where the second carrier has a second local part and a second connection part, the second connection part is connected between the second local part and the second conductive terminal, the second conductive terminal diverges from the second local part at a second distance (in other words, a width of a gap between the second conductive terminal and the second local part is the second distance), and the second distance is equal to a sum of the first distance and the first thickness or a difference between the first distance and the first thickness.

When the first carrier and the second carrier are stacked, if the second distance is equal to the sum of the first distance and the first thickness, the second carrier is stacked on a side of the first carrier and that is away from the first conductive terminal, and the second conductive terminal passes through the first carrier and is disposed side by side with the first conductive terminal. Alternatively, if the second distance is equal to the difference between the first distance and the first thickness, the second carrier is stacked on a side of the first carrier and that is close to the first conductive terminal, and the first conductive terminal passes through the second carrier and is disposed side by side with the second conductive terminal.

In an implementation, the first carrier has a first positioning hole, the second carrier has a second positioning hole, and the first positioning hole is aligned with the second positioning hole when the first carrier and the second carrier are stacked. In an embodiment, the first positioning hole and the second positioning hole may be aligned by using a pin of a feeding mechanism on a molding machine, so that the first conductive terminal and the second conductive terminal are accurately mutually positioned and both can be accurately positioned on the molding machine, to ensure that a size of the first supporting part formed by using an insert molding technology meets a specification requirement, and ensure relatively high accuracy of the size of the first supporting part, a position of the first supporting part relative to the first conductive terminal, and a position of the first supporting part relative to the second conductive terminal, thereby improving a yield rate of the electrical connector.

In an implementation, the electrical connector manufacturing method further includes:

after the first supporting part is formed, excising the first carrier and the second carrier to form the electrical connector.

In this embodiment, in the electrical connector manufacturing method, the first conductive terminal and the second conductive terminal are separately electroplated, the first conductive terminal and the second conductive terminal are then assembled, the first supporting part is then molded, and finally the first carrier and the second carrier are removed to form the electrical connector, so that electroplating costs of the electrical connector are significantly reduced while corrosion resistance of the electrical connector is ensured.

In an implementation, the electrical connector manufacturing method further includes:

providing a third carrier and at least one third conductive terminal connected to the third carrier, and electroplating the third conductive terminal to form a third electroplated layer, where the third carrier and the third conductive terminal may be stamped from a single conductive plate (for example, a copper plate), and the third carrier carries all third conductive terminals to undergo electroplating, to form third electroplated layers on the third conductive terminals;

providing a fourth carrier and at least one fourth conductive terminal connected to the fourth carrier, and electroplating the fourth conductive terminal to form a fourth electroplated layer, where a material of the fourth electroplated layer is different from a material of the third electroplated layer, the fourth carrier and the fourth conductive terminal may be stamped from a single conductive plate (for example, a copper plate), the fourth carrier carries all fourth conductive terminals to undergo electroplating, to form fourth electroplated layers on the fourth conductive terminals, and the material of the fourth electroplated layer of the electrical connector is different from the material of the third electroplated layer, so that the fourth conductive terminal and the third conductive terminal have different corrosion resistance performance;

stacking the third carrier and the fourth carrier, so that the third conductive terminal and the fourth conductive terminal are arranged in a spaced manner in a row in a same plane to form a second terminal assembly, where a same structure design is used for the fourth carrier and the third carrier, to quickly implement alignment of the fourth carrier and the third carrier and improve stacking precision during stacking;

forming a second supporting part on the second terminal assembly in an insert molding manner, where the second supporting part is fastened and connected to the third conductive terminal and the fourth conductive terminal, where an insulation material is used for the second supporting part; and assembling the first supporting part and the second supporting part, so that the first terminal assembly and the second terminal assembly are disposed in a back-to-back manner, where the first supporting part and the second supporting part enable the first terminal assembly and the second terminal assembly to be insulated from each other.

In this embodiment of this application, the electrical connector that has two rows of conductive terminals can be formed by using the electrical connector manufacturing method. In the electrical connector manufacturing method, the first conductive terminal, the second conductive terminal, the third conductive terminal, and the fourth conductive terminal can be separately electroplated to meet respective electroplating requirements of the conductive terminals, thereby greatly reducing consumption of a costly electroplating material (for example, a precious metal with strong corrosion resistance), and reducing electroplating costs while ensuring corrosion resistance performance. The first supporting part is formed on the first terminal assembly in the insert molding manner, and the second supporting part is formed on the second terminal assembly in the insert molding manner, to improve processing precision of the first supporting part and the second supporting part, thereby improving a yield rate of the electrical connector.

The assembling the first supporting part and the second supporting part includes:

sequentially stacking the first supporting part, a midplate, and the second supporting part; and fastening the first supporting part, the midplate, and the second supporting part to each other in an insert molding manner.

In this embodiment, the electrical connector manufacturing method is used to manufacture the electrical connector that serves as a female socket.

Alternatively, the assembling the first supporting part and the second supporting part includes:

providing a latch, where the latch is configured to fit into a fitting connector corresponding to the electrical connector; and fitting the first supporting part into the second supporting part by placing the first supporting part and the second supporting part on two opposite sides of the latch separately, where the first supporting part is fit into the second supporting part, for example, a protrusion is provided on the first supporting part, a groove is provided on the second supporting part, and the protrusion passes through the latch to fit into the groove, to implement mutual fastening.

In this embodiment, the electrical connector manufacturing method is used to manufacture the electrical connector that serves as a male connector.

In an implementation, after the first supporting part and the second supporting part are assembled, the electrical connector manufacturing method further includes:

excising the first carrier, the second carrier, the third carrier, and the fourth carrier to form the electrical connector.

In this embodiment, because the first carrier, the second carrier, the third carrier, and the fourth carrier have a same structure design and are stacked with each other for disposition, the first carrier, the second carrier, the third carrier, and the fourth carrier may be removed with one cut, and cutting efficiency is high. In this embodiment of this application, a manner of first assembling the first supporting part and the second supporting part and then excising the first carrier, the second carrier, the third carrier, and the fourth carrier is applicable to a process of manufacturing the electrical connector that serves as the male connector or the electrical connector that serves as the female socket.

Certainly, in another implementation, after the first supporting part and the second supporting part are separately formed, and before the first supporting part and the second supporting part are assembled, the electrical connector manufacturing method further includes:

excising the first carrier, the second carrier, the third carrier, and the fourth carrier.

In this embodiment, in the electrical connector manufacturing method, the electrical connector is formed in a manner of first excising the first carrier, the second carrier, the third carrier, and the fourth carrier, and then assembling the first supporting part and the second supporting part. This embodiment is applicable to a process of manufacturing the electrical connector that serves as the male connector.

In an implementation, the first terminal assembly is the same as the second terminal assembly, so that the electrical connector forms a USB Type-C interface. Specifically, the first conductive terminal is the same as the third conductive terminal, and the material of the first electroplated layer is the same as the material of the third electroplated layer. The second conductive terminal is the same as the fourth conductive terminal, and the second electroplated layer is the same as the fourth electroplated layer. An arrangement rule of the first conductive terminal and the second conductive terminal is the same as an arrangement rule of the third conductive terminal and the fourth conductive terminal.

DESCRIPTION OF EMBODIMENTS

The following describes the embodiments of this application with reference to the accompanying drawings in the embodiments of this application.

Figure 4:
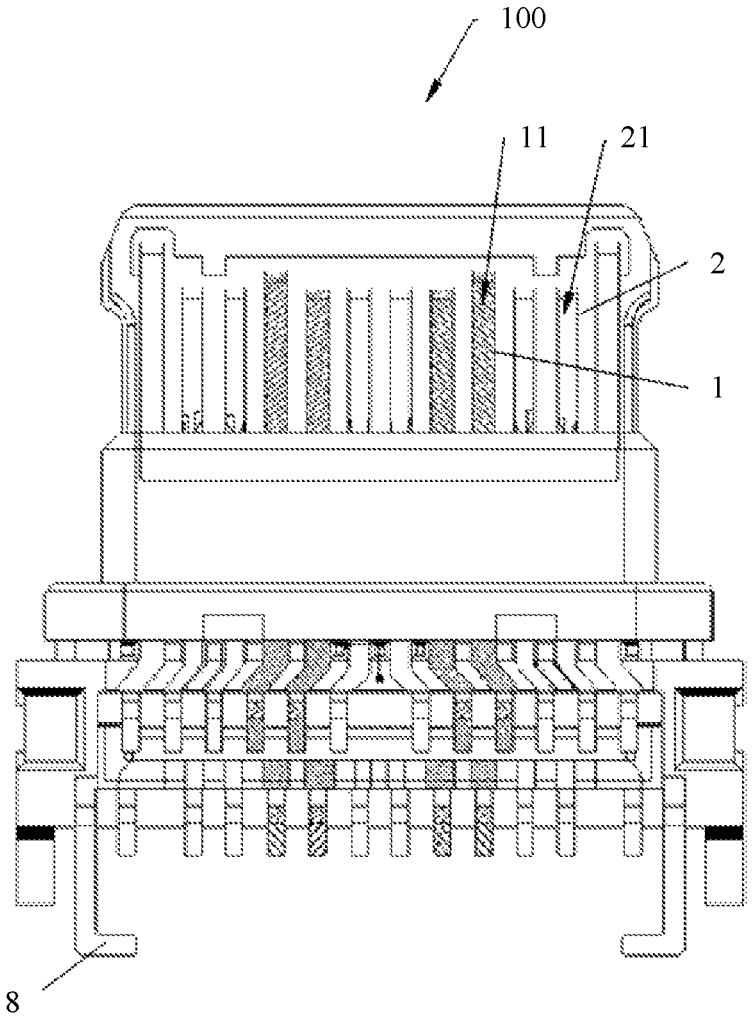
FIG. 4 is a schematic diagram of an electrical connector manufacturing method according to an embodiment of this application.
Figure 8:
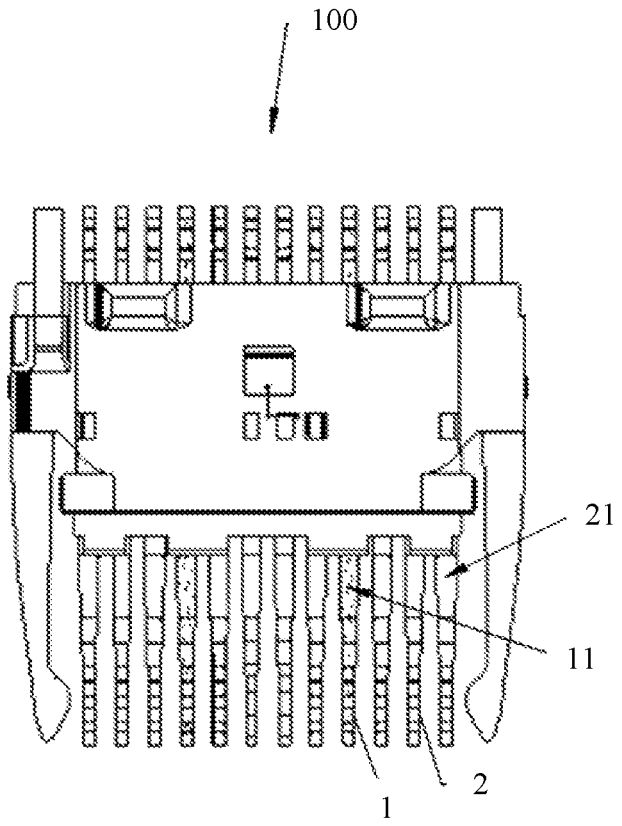
FIG. 8 is a schematic diagram of another electrical connector manufacturing method according to an embodiment of this application.

Referring to FIG. 4 and FIG. 8, an embodiment of this application provides an electrical connector 100. The electrical connector 100 includes a plurality of conductive terminals. The plurality of conductive terminals include at least one first conductive terminal 1 and at least one second conductive terminal 2. The first conductive terminal 1 and the second conductive terminal 2 are made of a conductive material, to implement an electrical connection function. A first electroplated layer 11 is disposed on an outer surface of the first conductive terminal 1. The first electroplated layer 11 has a corrosion resistance feature and is configured to prevent the first conductive terminal 1 from being corroded. A second electroplated layer 21 is disposed on an outer surface of the second conductive terminal 2. The second electroplated layer 21 has a corrosion resistance feature and is configured to prevent the second conductive terminal 2 from being corroded. A material of the second electroplated layer 21 is different from a material of the first electroplated layer 11. Electroplated layers made of different materials have different corrosion resistance performance (a capability of a material to resist a corrosion damage effect of a surrounding medium).

In this embodiment of this application, the material of the first electroplated layer 11 of the electrical connector 100 is different from the material of the second electroplated layer 21, so that the first conductive terminal 1 and the second conductive terminal 2 have different corrosion resistance performance. Therefore, conductive terminals of the electrical connector 100 may be selectively electroplated, to meet requirements in different application environments through different electroplating. For example, an electroplated layer (such as an electroplated layer that has a precious metal with strong corrosion resistance) with relatively strong corrosion resistance is formed, through electroplating, on a conductive terminal that is relatively easy to corrode, and an electroplated layer with general corrosion resistance is formed, through electroplating, on a conductive terminal that is less easy to corrode, so that all conductive terminals of the electrical connector 100 have good overall corrosion resistance performance and a long corrosion resistance time, and the electrical connector 100 has a longer life span. In addition, although the electroplated layer with relatively strong corrosion resistance is relatively costly, consumption of an electroplating material with strong corrosion resistance can be reduced for the electrical connector 100 to the greatest extent through selective electroplating, to reduce electroplating costs of the electrical connector 100. Therefore, the electrical connector 100 has both good corrosion resistance performance and low costs.

It may be understood that in this embodiment of this application, the first electroplated layer 11 may be a single-layer structure or a composite-layer structure. The second electroplated layer 21 may be a single-layer structure or a composite-layer structure. In this embodiment of this application, an example in which the first electroplated layer 11 is a composite-layer structure and the second electroplated layer 21 is a composite-layer structure is used for description.

Figure 1:
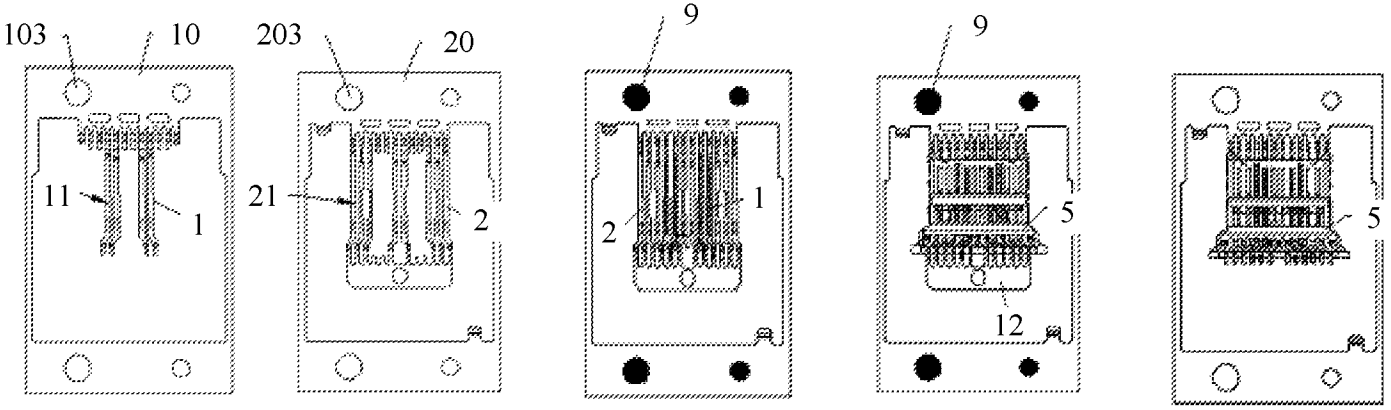
FIG. 1 is a schematic diagram of an electrical connector manufacturing method according to an embodiment of this application.
Figure 5:
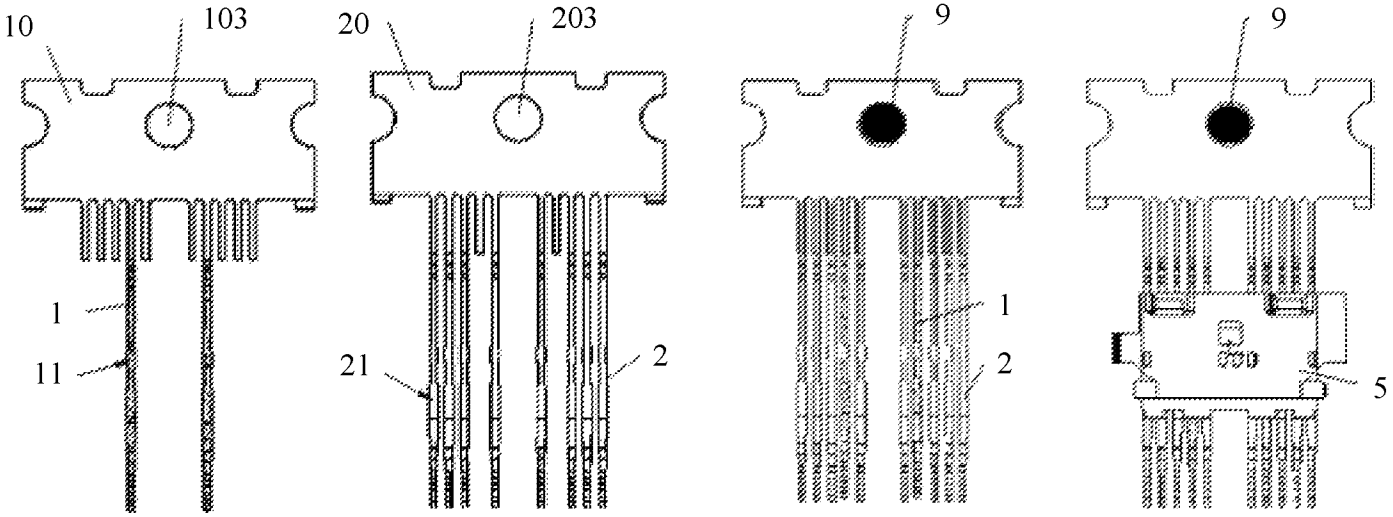
FIG. 5 is a schematic diagram of another electrical connector manufacturing method according to an embodiment of this application.

Optionally, referring to FIG. 1 and FIG. 5, a split-type carrier design may be used for the first conductive terminal 1 and the second conductive terminal 2, to meet requirements of separately performing electroplating to form the first electroplated layer 11 and the second electroplated layer 21, thereby greatly reducing consumption of a costly electroplating material (for example, a precious metal with strong corrosion resistance), and reducing electroplating costs while ensuring corrosion resistance performance. The split-type carrier design means that all first conductive terminals 1 are connected to a first carrier 10, all second conductive terminals 2 are connected to a second carrier 20, the first carrier 10 carries all the first conductive terminals 1 to undergo immersion plating, to form first electroplated layers 11 on the first conductive terminals 1, the second carrier 20 carries all the second conductive terminals 2 to undergo immersion plating, to form second electroplated layers 21 on the second conductive terminals 2, and then the first carrier 10 and the second carrier 20 are assembled to enable the first conductive terminals 1 and the second conductive terminals 2 to be regularly arranged.

In an optional embodiment, referring to FIG. 1, FIG. 5, FIG. 9, and FIG. 10, an on potential of the first conductive terminal 1 is higher than an on potential of the second conductive terminal 2. The first conductive terminal 1 may be a high-potential pin (PIN), for example, VBUS, CC, and SBU. The second conductive terminal 2 may be a low-potential pin (PIN). Corrosion resistance of the first electroplated layer 11 is higher than corrosion resistance of the second electroplated layer 21.

Because the first conductive terminal 1 with high on potential is easier to corrode than the second conductive terminal 2 with low on potential, overall corrosion resistance performance of the electrical connector 100 can be balanced by setting the corrosion resistance of the first electroplated layer 11 to be higher than the corrosion resistance of the second electroplated layer 21, and the electrical connector 100 has a long corrosion resistance time and a long life span.

Optionally, the first electroplated layer 11 has a precious metal such as rhodium/ruthenium/palladium in a platinum group metal. For example, the first electroplated layer 11 has a rhodium-ruthenium alloy material. Because the first electroplated layer 11 uses the precious metal with a corrosion resistance capability such as rhodium/ruthenium/palladium in the platinum group metal for stacking in a layer plating solution, the first electroplated layer 11 can significantly improve an electrolytic corrosion resistance capability and a life span of the first conductive terminal 1, and especially an electrolytic corrosion resistance capability in a humid environment with electricity. Because the first electroplated layer 11 is formed on the outer surface of the first conductive terminal 1 through electroplating and the second electroplated layer 21 formed on the outer surface of the second conductive terminal 2 through electroplating is different from the first electroplated layer 11, required consumption of a precious metal can be properly controlled even though an immersion plating manner is used for the first electroplated layer 11 due to an inherent feature of an electroplating solution, to prevent a sharp increase in electroplating costs of the electrical connector 100 that is caused because the consumption of the precious metal increases. Therefore, a solution of resisting electrolytic corrosion by performing electroplating by using the platinum group metal (such as rhodium and ruthenium) can be widely applied and promoted.

It may be understood that the platinum group metal (such as rhodium and ruthenium) in the first electroplated layer 11 may be used to form one or more layers in a stacked-layer structure of the first electroplated layer 11. In this embodiment of this application, an example in which the platinum group metal (such as rhodium and ruthenium) is used to form one layer in the stacked-layer structure of the first electroplated layer 11 is used for description. However, in another embodiment, the platinum group metal (such as rhodium and ruthenium) is used to form two or more layers in the stacked-layer structure of the first electroplated layer 11, to meet a higher corrosion resistance performance requirement.

Figure 9:
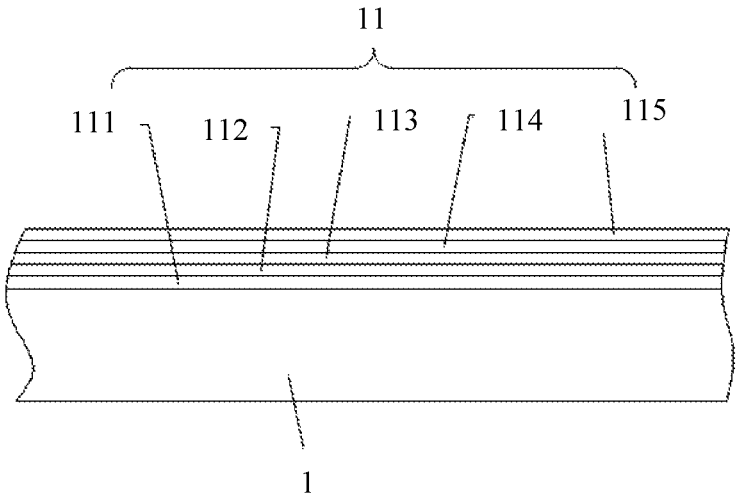
FIG. 9 is a schematic structural diagram of a first conductive terminal and a first electroplated layer according to an embodiment of this application.

Optionally, as shown in FIG. 9, the first electroplated layer 11 includes a copper plated layer 111, a wolfram-nickel plated layer 112, a gold plated layer 113, a palladium plated layer 114, and a rhodium-ruthenium plated layer 115 that are sequentially stacked on the outer surface of the first conductive terminal 1. The first electroplated layer 11 is manufactured through a series of technologies such as rinsing, activation, copper plating, wolfram-nickel plating, gold plating, palladium plating, rhodium-ruthenium plating, rinsing, and air-drying, so that the rhodium-ruthenium plated layer 115 is deposited on the surface of the first conductive terminal 1 and on an outermost side of the first electroplated layer 11 and that is away from the first conductive terminal 1, thereby improving corrosion resistance of the first conductive terminal 1.

A thickness of the rhodium-ruthenium plated layer 115 ranges from 0.25 μm to 2 μm, to ensure corrosion resistance performance of the first electroplated layer 11.

Further, thicknesses of other layer structures in the stacked-layer structure of the first electroplated layer 11 are as follows: A thickness of the copper plated layer 111 ranges from 1 μm to 3 μm; a thickness of the wolfram-nickel plated layer 112 ranges from 0.75 μm to 3 μm; a thickness of the gold plated layer 113 ranges from 0.05 μm to 0.5 μm; and a thickness of the palladium plated layer 114 ranges from 0.5 μm to 2 μm.

Figure 10:
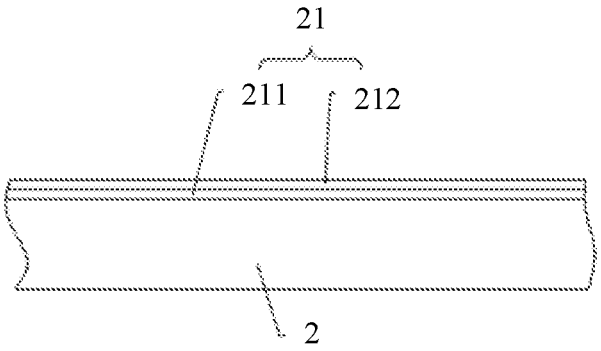
FIG. 10 is a schematic structural diagram of a second conductive terminal and a second electroplated layer according to an embodiment of this application.

Optionally, as shown in FIG. 10, the second electroplated layer 21 includes a nickel plated layer 211 and a gold plated layer 212 that are disposed in a stacked manner. The second electroplated layer 21 may be manufactured through a series of technologies such as rinsing, activation, nickel plating, gold plating, rinsing, and air-drying. A thickness of the nickel plated layer 211 is approximately 2.0 μm, and a thickness of the gold plated layer 212 is approximately 0.076 μm. The second electroplated layer 21 has low electroplating costs and can meet a corrosion resistance requirement of the second conductive terminal 2 as a low-potential conductive terminal.

Figure 11:
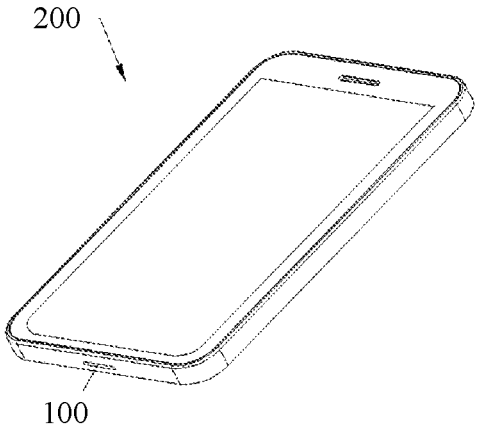
FIG. 11 is a schematic structural diagram of a mobile terminal according to an embodiment of this application.
Figure 12:
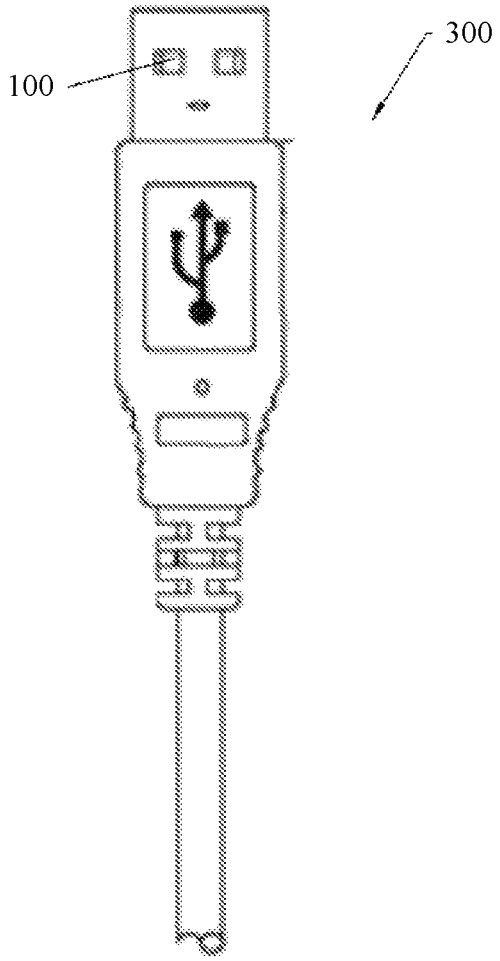
FIG. 12 is a schematic structural diagram of a data line according to an embodiment of this application.
Figure 13:
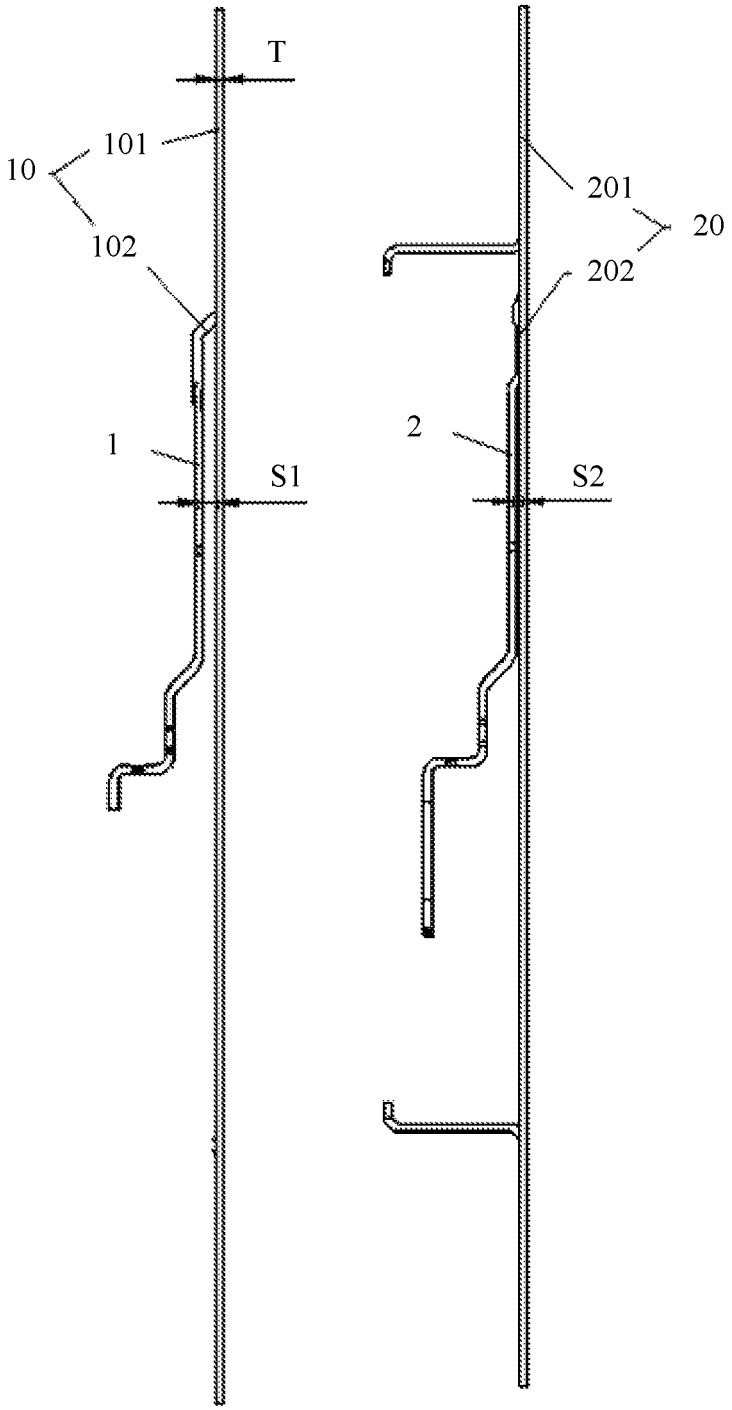
FIG. 13 is a side view of a first diagram and a side view of a second diagram in FIG. 1.
Figure 14:
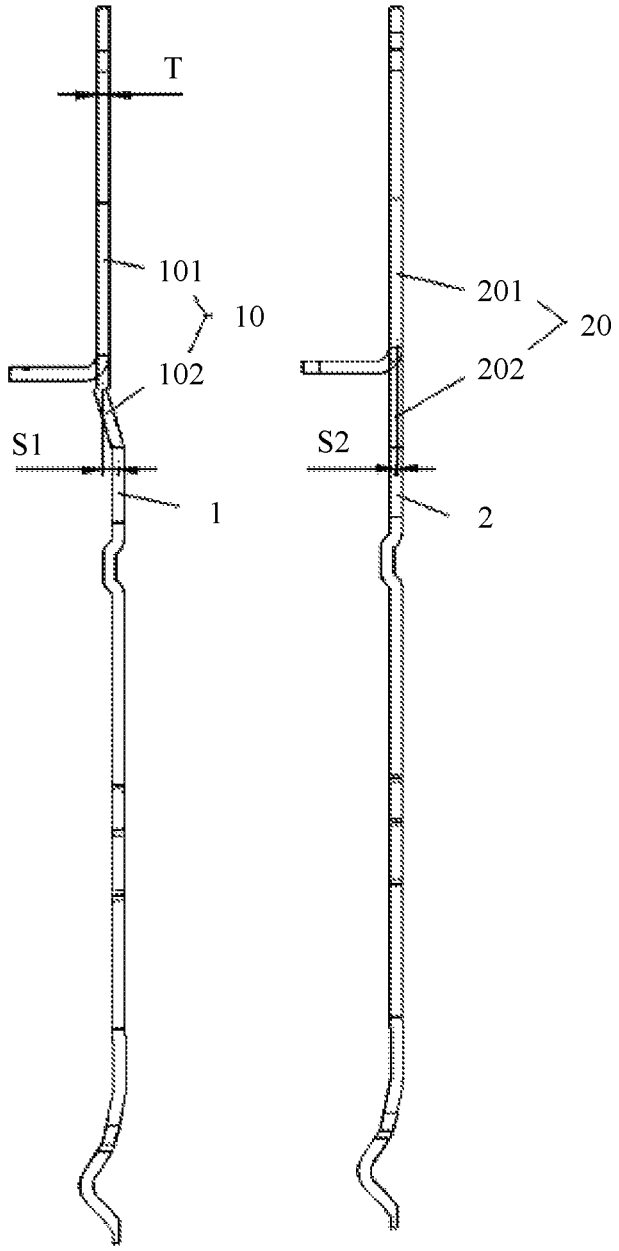
FIG. 14 is a side view of a first diagram and a side view of a second diagram in FIG. 5.

It may be understood that in this embodiment of this application, the electrical connector 100 may be a male connector or a female socket. For example, as shown in FIG. 11, the electrical connector 100 may be applied to a mobile terminal 200, and the electrical connector 100 is a female socket. As shown in FIG. 12, the electrical connector 100 may be applied to a data line 300, and the electrical connector 100 is a female socket of the data line 300, and is connected to a transmission line of the data line 300. The electrical connector 100 may also be applied to a device such as a charger, a mobile power supply, or a light fixture.

Optionally, the electrical connector 100 in this embodiment of this application is a USB Type-C interface.

In an embodiment, referring to FIG. 1 to FIG. 4, the electrical connector 100 is a USB female socket. The USB female socket includes a midplate 8 and an upper-row conductive terminal group and a lower-row conductive terminal group that are fastened on two opposite sides of the midplate 8. The upper-row conductive terminal group includes a first terminal assembly (1, 2) fastened by a first supporting part 5. The first terminal assembly (1, 2) includes at least one first conductive terminal 1 and at least one second conductive terminal 2. The lower-row conductive terminal group includes a second terminal assembly (3, 4) fastened by a second supporting part 6. The second terminal assembly (3, 4) has a same structure as the first terminal assembly (1, 2).

In another embodiment, referring to FIG. 5 to FIG. 8, the electrical connector 100 is a USB male connector. The USB male connector includes latches 7 and an upper-row conductive terminal group and a lower-row conductive terminal group that are fastened to the latches 7 on a side that the latches 7 face each other. The upper-row conductive terminal group includes a first terminal assembly (1, 2) fastened by a first supporting part 5. The first terminal assembly (1, 2) includes at least one first conductive terminal 1 and at least one second conductive terminal 2. The lower-row conductive terminal group includes a second terminal assembly (3, 4) fastened by a second supporting part 6. The second terminal assembly (3, 4) has a same structure as the first terminal assembly (1, 2). The first supporting part 5 is fit into the second supporting part 6. The latch 7 is configured to fit into a female socket corresponding to the USB male connector.

It may be understood that an arrangement of the conductive terminals in the terminal assembly of the USB female socket and an arrangement of the conductive terminals in the terminal assembly of the USB male connector are not required to be the same, but are independently designed according to respective specific requirements. A structure of the first supporting part 5 and a structure of the second supporting part 6 are not required to be the same, but are independently designed according to respective specific requirements.

Referring to FIG. 11, an embodiment of this application further provides a mobile terminal 200. The mobile terminal 200 includes the electrical connector 100 described in the foregoing embodiment. The mobile terminal 200 in this embodiment of this application may be any device that has a communication function and a storage function, such as an intelligent device that has a network function, for example, a tablet computer, a mobile phone, an e-reader, a remote control, a personal computer (PC), a notebook computer, an in-vehicle device, a web television, or a wearable device.

An embodiment of this application further provides an electrical connector manufacturing method. The electrical connector manufacturing method may be used to manufacture the electrical connector 100 described in the foregoing embodiment.

Referring to FIG. 1 and FIG. 5, the electrical connector manufacturing method includes the following steps:

S01. Provide a first carrier 10 and at least one first conductive terminal 1 connected to the first carrier 10, and electroplate the first conductive terminal 1 to form a first electroplated layer 11. The first carrier 10 and the first conductive terminal 1 may be stamped from a single conductive plate (for example, a copper plate). The first carrier 10 carries all first conductive terminals 1 to undergo electroplating, to form first electroplated layers 11 on the first conductive terminals 1.

S02. Provide a second carrier 20 and at least one second conductive terminal 2 connected to the second carrier 20, and electroplate the second conductive terminal 2 to form a second electroplated layer 21, where a material of the second electroplated layer 21 is different from a material of the first electroplated layer 11. The second carrier 20 and the second conductive terminal 2 may be stamped from a single conductive plate (for example, a copper plate). The second carrier 20 carries all second conductive terminals 2 to undergo electroplating, to form second electroplated layers 21 on the second conductive terminals 2. The material of the second electroplated layer 21 of the electrical connector 100 is different from the material of the second electroplated layer 21, so that the first conductive terminal 1 and the second conductive terminal 2 have different corrosion resistance performance.

S03. Stack the first carrier 10 and the second carrier 20, so that the first conductive terminal 1 and the second conductive terminal 2 are arranged in a spaced manner in a row in a same plane to form a first terminal assembly (1, 2). A same structure design is used for the second carrier 20 and the first carrier 10, to quickly implement alignment of the second carrier 20 and the first carrier 10 and improve stacking precision during stacking.

S04. Form a first supporting part 5 on the first terminal assembly (1, 2) in an insert molding (Insert molding) manner, where the first supporting part 5 is fastened and connected to the first conductive terminal 1 and the second conductive terminal 2. An insulation material is used for the first supporting part 5.

In this embodiment of this application, because the first conductive terminal 1 is connected to the first carrier 10 and the second conductive terminal 2 is connected to the second carrier 20, the first conductive terminal 1 and the second conductive terminal 2 can be separately electroplated to meet respective electroplating requirements of the first electroplated layer 11 and the second electroplated layer 21, thereby greatly reducing consumption of a costly electroplating material (for example, a precious metal with strong corrosion resistance), and reducing electroplating costs while ensuring corrosion resistance performance. The first supporting part 5 is formed on the first terminal assembly (1, 2) in the insert molding manner, to improve processing precision of the first supporting part 5 and robustness of a connection between the first conductive terminal 1 and the second conductive terminal 2.

Optionally, an on potential of the first conductive terminal 1 is higher than an on potential of the second conductive terminal 2, and corrosion resistance of the first electroplated layer 11 is higher than corrosion resistance of the second electroplated layer 21. The first conductive terminal 1 may be a high-potential pin (PIN), for example, VBUS, CC, and SBU. Because the first conductive terminal 1 with high on potential is easier to corrode than the second conductive terminal 2 with low on potential, overall corrosion resistance performance of the electrical connector 100 can be balanced by setting the corrosion resistance of the first electroplated layer 11 to be higher than the corrosion resistance of the second electroplated layer 21, and the electrical connector 100 has a long corrosion resistance time and a long life span.

Optionally, referring to FIG. 9, a process of electroplating the first conductive terminal 1 to form the first electroplated layer 11 includes the following steps:

S013. Perform electroplating to form a copper plated layer 111 on an outer surface of the first conductive terminal 1, where a thickness of the copper plated layer 111 ranges from 1 μm to 3 μm.

S014. Perform electroplating to form a wolfram-nickel plated layer 112 on the copper plated layer 111, where a thickness of the wolfram-nickel plated layer 112 ranges from 0.75 μm to 3 μm.

S015. Perform electroplating to form a gold plated layer 113 on the wolfram-nickel plated layer 112, where a thickness of the gold plated layer 113 ranges from 0.05 μm to 0.5 μm.

S016. Perform electroplating to form a palladium plated layer 114 on the gold plated layer 113, where a thickness of the palladium plated layer 114 ranges from 0.5 μm to 2 μm.

S017. Perform electroplating to form a rhodium-ruthenium plated layer 115 on the palladium plated layer 114, where a thickness of the rhodium-ruthenium plated layer 115 ranges from 0.25 μm to 2 μm.

In this embodiment, because the first electroplated layer 11 uses a precious metal with a corrosion resistance capability such as rhodium/ruthenium/palladium in a platinum group metal for stacking in a layer plating solution, the first electroplated layer 11 can significantly improve an electrolytic corrosion resistance capability and a life span of the first conductive terminal 1, and especially an electrolytic corrosion resistance capability in a humid environment with electricity. Because the first electroplated layer 11 is formed on the outer surface of the first conductive terminal 1 through electroplating and the second electroplated layer 21 formed on the outer surface of the second conductive terminal 2 through electroplating is different from the first electroplated layer 11, required consumption of a precious metal can be properly controlled even though an immersion plating manner is used for the first electroplated layer 11 due to an inherent feature of an electroplating solution, to prevent a sharp increase in electroplating costs of the electrical connector 100 that is caused because the consumption of the precious metal increases. Therefore, a solution of resisting electrolytic corrosion by performing electroplating by using the platinum group metal (such as rhodium and ruthenium) can be widely applied and promoted.

Before the copper plated layer 111 is formed through electroplating, the process of electroplating the first conductive terminal 1 to form the first electroplated layer 11 further includes the following steps:

S011. Rinse the outer surface of the first conductive terminal 1. In this case, the outer surface of the first conductive terminal 1 has a relatively high degree of cleanliness, to meet a cleanliness requirement of a subsequent technology.

S012. Activate an oxide film on the outer surface of the first conductive terminal 1.

After the rhodium-ruthenium plated layer 115 is formed through electroplating, the process of electroplating the first conductive terminal 1 to form the first electroplated layer 11 further includes the following step:

S018. Rinse and air-dry the rhodium-ruthenium plated layer 115 to form the first electroplated layer 11.

In this embodiment, the first electroplated layer 11 is manufactured through a series of technologies such as rinsing, activation, copper plating, wolfram-nickel plating, gold plating, palladium plating, rhodium-ruthenium plating, rinsing, and air-drying, so that the rhodium-ruthenium plated layer 115 is deposited on the surface of the first conductive terminal 1 and on an outermost side that is of the first electroplated layer 11 and that is away from the first conductive terminal 1, thereby improving corrosion resistance of the first conductive terminal 1.

Optionally, referring to FIG. 10, a process of electroplating the second conductive terminal 2 to form the second electroplated layer 21 includes the following steps:

S021. Perform electroplating to form a nickel plated layer 211 on an outer surface of the second conductive terminal 2, where a thickness of the nickel plated layer 211 is approximately 2.0 μm. Before the nickel plated layer 211 is formed through electroplating, the outer surface of the second conductive terminal 2 is rinsed, and an oxide film on the outer surface of the second conductive terminal 2 is activated.

S022. Perform electroplating to form a gold plated layer 212 on the nickel plated layer 211, so as to form the second electroplated layer 21, where a thickness of the gold plated layer 212 is approximately 0.076 μm. After the gold plated layer 212 is formed, the gold plated layer 212 is rinsed and air-dried.

In this embodiment, the second electroplated layer 21 has low electroplating costs and can meet a corrosion resistance requirement of the second conductive terminal 2 as a low-potential conductive terminal.

Optionally, referring to FIG. 1, FIG. 5, FIG. 13, and FIG. 14, the providing a first carrier 10 and at least one first conductive terminal 1 connected to the first carrier 10 includes: stamping the first carrier 10 and the at least one first conductive terminal 1 from a first conductive plate. The first carrier 10 has a first local part 101 and a first connection part 102, and the first connection part 102 is connected between the first local part 101 and the first conductive terminal 1. The first conductive terminal 1 diverges from the first local part 101 at a first distance S1. The first local part 101 has a first thickness T.

Figure 3:
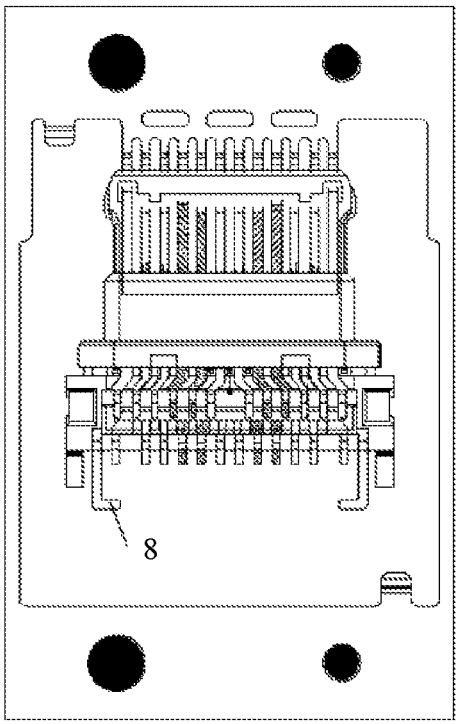
FIG. 3 is a schematic diagram of an electrical connector manufacturing method according to an embodiment of this application.

Referring to FIG. 3 and FIG. 12, the providing a second carrier 20 and at least one second conductive terminal 2 connected to the second carrier 20 includes: stamping the second carrier 20 and the at least one second conductive terminal 2 from a second conductive plate. The second carrier 20 has a second local part 201 and a second connection part 202, and the second connection part 202 is connected between the second local part 201 and the second conductive terminal 2. The second conductive terminal 2 diverges from the second local part 201 at a second distance S2. A thickness of the second local part 201 is equal to the first thickness T. The second distance S2 is equal to a sum of the first distance S1 and the first thickness T or a difference between the first distance S1 and the first thickness T.

When the first carrier 10 and the second carrier 20 are stacked, if the second distance S2 is equal to the sum of the first distance S1 and the first thickness T, the second carrier 20 is stacked on a side of the first carrier 10 and that is away from the first conductive terminal 1, and the second conductive terminal 2 passes through the first carrier 10 and is disposed side by side with the first conductive terminal 1. Alternatively, if the second distance S2 is equal to the difference between the first distance S1 and the first thickness T, the second carrier 20 is stacked on a side of the first carrier 10 and that is close to the first conductive terminal 1, and the first conductive terminal 1 passes through the second carrier 20 and is disposed side by side with the second conductive terminal 2. The first conductive plate may be a copper plate, and the second conductive plate may be a copper plate.

Optionally, referring to FIG. 1 and FIG. 5, the first carrier 10 has a first positioning hole 103, and the second carrier 20 has a second positioning hole 203. The first positioning hole 103 is aligned with the second positioning hole 203 when the first carrier 10 and the second carrier 20 are stacked. In an embodiment, the first positioning hole 103 and the second positioning hole 203 may be aligned by using a pin 9 of a feeding mechanism on a molding machine, so that the first conductive terminal 1 and the second conductive terminal 2 are accurately mutually positioned and both can be accurately positioned on the molding machine, to ensure that a size of the first supporting part 5 formed by using an insert molding technology meets a specification requirement, and ensure relatively high accuracy of the size of the first supporting part 5, a position of the first supporting part 5 relative to the first conductive terminal 1, and a position of the first supporting part 5 relative to the second conductive terminal 2, thereby improving a yield rate of the electrical connector 100.

In an embodiment, the electrical connector manufacturing method further includes the following step:

S05. After the first supporting part 5 is formed, remove the first carrier 10 and the second carrier 20 to form the electrical connector 100.

In this embodiment, in the electrical connector manufacturing method, the first conductive terminal 1 and the second conductive terminal 2 are separately electroplated, the first conductive terminal 1 and the second conductive terminal 2 are then assembled, the first supporting part 5 is then molded, and finally the first carrier 10 and the second carrier 20 are removed to form the electrical connector 100, so that electroplating costs of the electrical connector 100 are significantly reduced while corrosion resistance of the electrical connector 100 is ensured.

In another embodiment, referring to FIG. 1 to FIG. 8, the electrical connector manufacturing method further includes the following steps:

S01'. Provide a third carrier 30 and at least one third conductive terminal 3 connected to the third carrier 30, and electroplate the third conductive terminal 3 to form a third electroplated layer 31. The third carrier 30 and the third conductive terminal 3 may be stamped from a single conductive plate (for example, a copper plate). The third carrier 30 carries all third conductive terminals 3 to undergo electroplating, to form third electroplated layers 31 on the third conductive terminals 3.

S02'. Provide a fourth carrier 40 and at least one fourth conductive terminal 4 connected to the fourth carrier 40, and electroplate the fourth conductive terminal 4 to form a fourth electroplated layer 41, where a material of the fourth electroplated layer 41 is different from a material of the third electroplated layer 31. The fourth carrier 40 and the fourth conductive terminal 4 may be stamped from a single conductive plate (for example, a copper plate). The fourth carrier 40 carries all fourth conductive terminals 4 to undergo electroplating, to form fourth electroplated layers 41 on the fourth conductive terminals 4. The material of the fourth electroplated layer 41 of the electrical connector 100 is different from the material of the third electroplated layer 31, so that the fourth conductive terminal 4 and the third conductive terminal 3 have different corrosion resistance performance.

S03'. Stack the third carrier 30 and the fourth carrier 40, so that the third conductive terminal 3 and the fourth conductive terminal 4 are arranged in a spaced manner in a row in a same plane to form a second terminal assembly (3, 4). A same structure design is used for the fourth carrier 40 and the third carrier 30, to quickly implement alignment of the fourth carrier 40 and the third carrier 30 and improve stacking precision during stacking.

S04'. Form a second supporting part 6 on the second terminal assembly (3, 4) in an insert molding (Insert molding) manner, where the second supporting part 6 is fastened and connected to the third conductive terminal 3 and the fourth conductive terminal 4. An insulation material is used for the second supporting part 6. A positioning hole 303 of the third carrier 30 and a positioning hole 403 of the fourth carrier 40 may be aligned by using the pin 9 of the feeding mechanism on the molding machine.

S051. Assemble the first supporting part 5 and the second supporting part 6, so that the first terminal assembly (1, 2) and the second terminal assembly (3, 4) are disposed in a back-to-back manner. The first supporting part 5 and the second supporting part 6 enable the first terminal assembly (1, 2) and the second terminal assembly (3, 4) to be insulated from each other.

In this embodiment of this application, the electrical connector 100 that has two rows of conductive terminals can be formed by using the electrical connector manufacturing method. In the electrical connector manufacturing method, the first conductive terminal 1, the second conductive terminal 2, the third conductive terminal 3, and the fourth conductive terminal 4 can be separately electroplated to meet respective electroplating requirements of the conductive terminals, thereby greatly reducing consumption of a costly electroplating material (for example, a precious metal with strong corrosion resistance), and reducing electroplating costs while ensuring corrosion resistance performance. The first supporting part 5 is formed on the first terminal assembly (1, 2) in the insert molding manner, and the second supporting part 6 is formed on the second terminal assembly (3, 4) in the insert molding manner, to improve processing precision of the first supporting part 5 and the second supporting part 6, thereby improving a yield rate of the electrical connector 100.

Optionally, as shown in FIG. 1, in step S01, an end of the first conductive terminal 1 and that is away from the first carrier 10 is further connected to a first sub-carrier 12. In other words, the first conductive terminal 1 is connected between the first carrier 10 and the first sub-carrier 12, and the first sub-carrier 12 is configured to hold the first conductive terminal 1, to improve processing precision and subsequent assembly quality of the first conductive terminal 1. After the first supporting part 5 is formed, the first sub-carrier 12 can be removed. For example, after the first supporting part 5 is formed and before the first supporting part 5 and the second supporting part 6 are assembled (in step S051), the first sub-carrier 12 is first removed.

Certainly, in step S02, an end of the second conductive terminal 2 and that is away from the second carrier 20 may also be connected to a second sub-carrier 22. After the first supporting part 5 is formed, the second sub-carrier 22 is removed. In step S01', an end of the third conductive terminal 3 and that is away from the third carrier 30 may also be connected to a third sub-carrier. After the second supporting part 6 is formed, the third sub-carrier is removed. In step S02', an end of the fourth conductive terminal 4 and that is away from the fourth carrier 40 may also be connected to a fourth sub-carrier. After the second supporting part 6 is formed, the fourth sub-carrier is removed.

Figure 2:
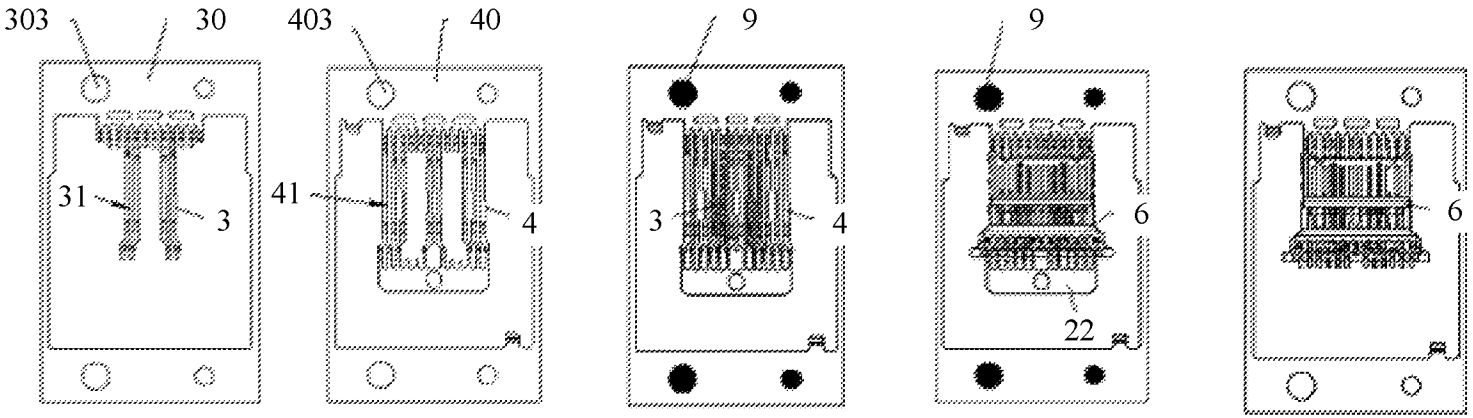
FIG. 2 is a schematic diagram of an electrical connector manufacturing method according to an embodiment of this application.

In an optional embodiment, referring to FIG. 1 to FIG. 3, the assembling the first supporting part 5 and the second supporting part 6 includes the following steps:

S0511. Sequentially stack the first supporting part 5, a midplate 8, and the second supporting part 6.

S0512. Fasten the first supporting part 5, the midplate 8, and the second supporting part 6 to each other in an insert molding manner.

In this embodiment, the electrical connector manufacturing method is used to manufacture the electrical connector 100 that serves as a female socket.

Figure 6:
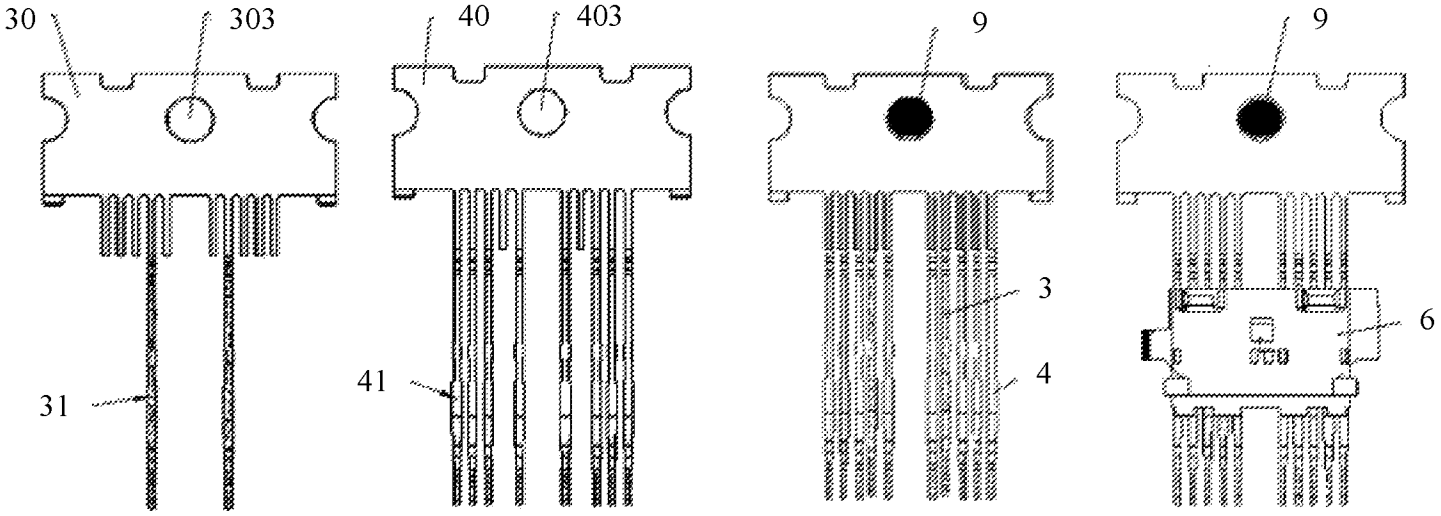
FIG. 6 is a schematic diagram of another electrical connector manufacturing method according to an embodiment of this application.
Figure 7:
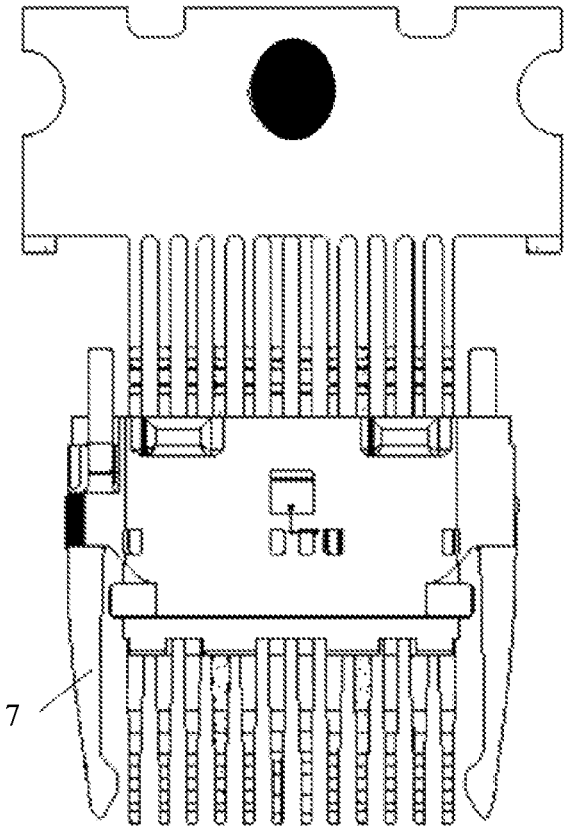
FIG. 7 is a schematic diagram of another electrical connector manufacturing method according to an embodiment of this application.

In another optional embodiment, referring to FIG. 5 to FIG. 7, the assembling the first supporting part 5 and the second supporting part 6 includes the following steps:

S0511. Provide a latch 7, where the latch 7 is configured to fit into a fitting connector corresponding to the electrical connector 100.

S0512. Fit the first supporting part 5 into the second supporting part 6 by placing the first supporting part 5 and the second supporting part 6 on two opposite sides of the latch 7 separately. The first supporting part 5 is fit into the second supporting part 6. For example, a protrusion is provided on the first supporting part 5, a groove is provided on the second supporting part 6, and the protrusion passes through the latch 7 to fit into the groove, to implement mutual fastening.

In this embodiment, the electrical connector manufacturing method is used to manufacture the electrical connector 100 that serves as a male connector.

Optionally, after the first supporting part 5 and the second supporting part 6 are assembled, the electrical connector manufacturing method further includes the following step:

S052. Remove the first carrier 10, the second carrier 20, the third carrier 30, and the fourth carrier 40 to form the electrical connector 100.

In this embodiment, because the first carrier 10, the second carrier 20, the third carrier 30, and the fourth carrier 40 have a same structure design and are stacked with each other for disposition, the first carrier 10, the second carrier 20, the third carrier 30, and the fourth carrier 40 may be removed with one cut, and cutting efficiency is high. In this embodiment of this application, as shown in FIG. 3, FIG. 4, FIG. 7, and FIG. 8, a manner of first assembling the first supporting part 5 and the second supporting part 6 and then excising the first carrier 10, the second carrier 20, the third carrier 30, and the fourth carrier 40 is applicable to a process of manufacturing the electrical connector 100 that serves as the male connector or the electrical connector 100 that serves as the female socket.

Certainly, in another implementation, after the first supporting part 5 and the second supporting part 6 are separately formed, and before the first supporting part 5 and the second supporting part 6 are assembled, the electrical connector manufacturing method further includes:

excising the first carrier 10, the second carrier 20, the third carrier 30, and the fourth carrier 40.

In this embodiment, in the electrical connector manufacturing method, the electrical connector 100 is formed in a manner of first excising the first carrier 10, the second carrier 20, the third carrier 30, and the fourth carrier 40 and then assembling the first supporting part 5 and the second supporting part 6. This embodiment is applicable to a process of manufacturing the electrical connector 100 that serves as the male connector.

Optionally, the first terminal assembly (1, 2) is the same as the second terminal assembly (3, 4), so that the electrical connector 100 forms a USB Type-C interface. Specifically, the first conductive terminal 1 is the same as the third conductive terminal 3, and the material of the first electroplated layer 11 is the same as the material of the third electroplated layer 31. The second conductive terminal 2 is the same as the fourth conductive terminal 4, and the second electroplated layer 21 is the same as the fourth electroplated layer 41. An arrangement rule of the first conductive terminal 1 and the second conductive terminal 2 is the same as an arrangement rule of the third conductive terminal 3 and the fourth conductive terminal 4.

In other words, in an implementation, a same carrier design is used for an upper-row terminal and a lower-row terminal of a female socket of a connector. After the terminals are stamped from split-type carriers (referring to the first carrier 10 and the second carrier 20), electroplating is performed to separately form a rhodium-ruthenium plated layer (referring to the first electroplated layer 11) and a conventional plated layer (referring to the second electroplated layer 21). Molding in a process is implemented in the following steps:

1. When insert molding is to be performed on the upper-row terminal and the lower-row terminal, align positioning holes of the split-type carriers by using the pin of the feeding mechanism on the molding machine, and further perform insert molding after the conductive terminals of the split-type carriers are positioned, to ensure that a size obtained after the insert molding meets a specification requirement.

2. Then perform tongue molding by using an upper molded part, a lower molded part, and a midplate together, and remove the carriers after the molding is completed. A completed tongue is shown in FIG. 4. Compared with a conventional method in which conventional electroplating is performed on all tongues, in this method, rhodium-ruthenium electroplating is performed on a VBUS terminal, a CC terminal, and an SBU terminal, and conventional electroplating is performed on another terminal. For a difference between the two methods, refer to FIG. 4. For a process of a detailed part, refer to FIG. 1 to FIG. 4.

In another implementation, similarly, after an upper-row terminal and a lower-row terminal of a male connector of a connector are stamped from split-type carriers (referring to the first carrier 10 and the second carrier 20), electroplating is performed to separately form a rhodium-ruthenium plated layer (referring to the first electroplated layer 11) and a conventional plated layer (referring to the second electroplated layer 21). Molding in a process is implemented in the following steps:

1. When insert molding is to be performed on the upper-row terminal and the lower-row terminal, align positioning holes of split-type carriers by using the pin of the feeding mechanism on the molding machine, and further perform the insert molding after the conductive terminals of the split-type carriers are positioned, to ensure that a size obtained after the insert molding meets a specification requirement.

2. After molding of the upper-row terminal and the lower-row terminal is completed, assemble the upper-row terminal, the lower-row terminal, and the latch, and then remove the carriers (or remove the carriers and then assemble the upper-row terminal, the lower-row terminal, and the latch), to complete a three-in-one semi-manufactured product of the male connector of the connector. Compared with a conventional method in which conventional electroplating is performed on all male connectors, in this method, rhodium-ruthenium electroplating is performed on a VBUS terminal, and conventional electroplating is performed on a remaining terminal. For a difference between the two methods, refer to FIG. 8. For a process of a detailed part, refer to FIG. 5 to FIG. 8.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A Universal Serial Bus (USB) interface, comprising:
at least one first conductive terminal; and
at least one second conductive terminal;
wherein
a first electroplated layer is disposed on an outer surface of the first conductive terminal, wherein the first electroplated layer includes at least one of rhodium, ruthenium, and palladium, and a second electroplated layer is free of rhodium, ruthenium, and palladium,
the second electroplated layer is disposed on an outer surface of the second conductive terminal, and a material of the second electroplated layer is different from a material of the first electroplated layer,
an on potential of the first conductive terminal is higher than an on potential of the second conductive terminal,
corrosion resistance of the first electroplated layer is higher than corrosion resistance of the second electroplated layer; and
the first conductive terminal is a virtual bus (VBUS) pin, a CC pin or a SBU pin.

2. The USB interface according to claim 1, wherein the first electroplated layer has a rhodium-ruthenium alloy material.

3. The USB interface according to claim 2, wherein the first electroplated layer comprises a copper plated layer, a wolfram-nickel plated layer, a gold plated layer, a palladium plated layer, and a rhodium-ruthenium plated layer that are sequentially stacked on the outer surface of the first conductive terminal.

4. The USB interface according to claim 3, wherein a thickness of the rhodium-ruthenium plated layer ranges from 0.25 μm to 2 μm.

5. The USB interface according to claim 1, wherein the second electroplated layer comprises a nickel plated layer and a gold plated layer that are disposed in a stacked manner.

6. The USB interface according to claim 1, wherein the USB interface is a USB female socket or a USB male connector.

7. The USB interface according to claim 1, wherein the USB interface is a USB TYPE-C interface.

8. A mobile terminal, wherein the mobile terminal comprises an Universal Serial Bus (USB) interface; wherein the USB interface comprises at least one first conductive terminal and at least one second conductive terminal, wherein a first electroplated layer is disposed on an outer surface of the first conductive terminal and includes at least one of rhodium, ruthenium, and palladium, and a second electroplated layer is free of rhodium, ruthenium, and palladium, the second electroplated layer is disposed on an outer surface of the second conductive terminal, and a material of the second electroplated layer is different from a material of the first electroplated layer; wherein on potential of the first conductive terminal is higher than on potential of the second conductive terminal, and corrosion resistance of the first electroplated layer is higher than corrosion resistance of the second electroplated layer; the first conductive terminal is VBUS, CC or SBU.

9. The mobile terminal according to claim 8, wherein the first electroplated layer has a rhodium-ruthenium alloy material.

10. The mobile terminal according to claim 8, wherein the mobile terminal is a tablet computer, a mobile phone, an e-reader, a remote control, a personal computer, a notebook computer, an in-vehicle device, a web television, or a wearable device.

11. The mobile terminal according to claim 10, wherein the first electroplated layer has a rhodium-ruthenium alloy material.

12. The mobile terminal according to claim 8, wherein the first electroplated layer comprises a copper plated layer, a wolfram-nickel plated layer, a gold plated layer, a palladium plated layer, and a rhodium-ruthenium plated layer.

13. The mobile terminal according to claim 12, wherein a thickness of the rhodium-ruthenium plated layer ranges from 0.25 μm to 2 μm.

14. The mobile terminal according to claim 8, wherein the second electroplated layer comprises a nickel plated layer and a gold plated layer.

15. The mobile terminal according to claim 8, wherein the USB interface is USB TYPE-C interface.

16. An electrical connector manufacturing method, comprising:
electroplating each first conductive terminal connected to a first carrier, to form a first electroplated layer;
electroplating the second conductive terminal connected to a second carrier, to form a second electroplated layer, wherein a material of the second electroplated layer is different from a material of the first electroplated layer;
stacking the first carrier and the second carrier, so that the first conductive terminal and the second conductive terminal are arranged in a spaced manner in a row in a same plane to form a first terminal assembly; and forming a first supporting part on the first terminal assembly by insert molding, wherein the first supporting part is fastened and connected to the first conductive terminal and the second conductive terminal.

17. The electrical connector manufacturing method according to claim 16, wherein an on potential of the first conductive terminal is higher than an on potential of the second conductive terminal, and corrosion resistance of the first electroplated layer is higher than corrosion resistance of the second electroplated layer.

18. The electrical connector manufacturing method according to claim 17, wherein the electroplating of the first conductive terminal to form the first electroplated layer comprises:

performing electroplating to form a copper plated layer on an outer surface of the first conductive terminal;

performing electroplating to form a wolfram-nickel plated layer on the copper plated layer;

performing electroplating to form a gold plated layer on the wolfram-nickel plated layer;

performing electroplating to form a palladium plated layer on the gold plated layer; and performing electroplating to form a rhodium-ruthenium plated layer on the palladium plated layer.

19. The electrical connector manufacturing method according to claim 18, wherein before the copper plated layer is formed through electroplating, the electroplating of the first conductive terminal to form the first electroplated layer further comprises:

rinsing the outer surface of the first conductive terminal; and activating an oxide film on the outer surface of the first conductive terminal; and after the rhodium-ruthenium plated layer is formed through electroplating, the electroplating the first conductive terminal to form the first electroplated layer further comprises:

rinsing and air-drying the rhodium-ruthenium plated layer to form the first electroplated layer.

20. The electrical connector manufacturing method according to claim 18, wherein the electroplating of the second conductive terminal to form the second electroplated layer comprises:

performing electroplating to form a nickel plated layer on an outer surface of the second conductive terminal; and performing electroplating to form a gold plated layer on the nickel plated layer, so as to form the second electroplated layer.

* * * * *